US009738104B1

(12) United States Patent
Garcia, III

(10) Patent No.: US 9,738,104 B1
(45) Date of Patent: Aug. 22, 2017

(54) COMIC PROTECTOR

(71) Applicant: Ultra Pro International, LLC, Commerce, CA (US)

(72) Inventor: Joseph Ralph Garcia, III, Burbank, CA (US)

(73) Assignee: Ultra Pro International, LLC, Commerce ( * ) Notice: Subject to any disclaimer, the term of this patent is extended or adjusted under 35 U.S.C. 154(b) by 0 days.

(21) Appl. No.: 15/136,806

(22) Filed: Apr. 22, 2016

(51) Int. Cl.

| | |
|---|---|
| ***A45F 5/12*** | (2006.01) |
| ***B42D 3/04*** | (2006.01) |
| ***B65B 25/14*** | (2006.01) |
| ***B65B 51/02*** | (2006.01) |
| ***B65B 5/04*** | (2006.01) |

(52) U.S. Cl.
CPC ..... *B42D 3/045* (2013.01); *B65B 5/04* (2013.01); *B65B 25/14* (2013.01); *B65B 51/02* (2013.01)

(58) Field of Classification Search
USPC .... 206/424, 308.1, 312, 313, 427, 449, 776, 206/232, 472, 473, 475; 190/901, 902; 283/57, 109, 112, 67; 281/20, 34, 35, 281/15.1, 19.1, 43, 48, 47; 40/661, 116; 383/63, 106; 402/70
See application file for complete search history.

(56) References Cited

U.S. PATENT DOCUMENTS

| | | | | |
|---|---|---|---|---|
| 2,330,619 A * | 9/1943 | Pomeranz | B65D 75/28 | 206/424 |
| 2,728,450 A * | 12/1955 | Haire | B65D 75/06 | 206/424 |
| 2,931,557 A * | 4/1960 | Loderhose | B65D 85/544 | 206/216 |
| 2,986,325 A * | 5/1961 | Loderhose | B65D 85/546 | 206/216 |
| 3,061,172 A * | 10/1962 | Loderhose | B65D 85/546 | 206/312 |
| 3,174,244 A * | 3/1965 | Walton | B42D 15/042 | 229/82 |
| 3,426,960 A * | 2/1969 | Shore | B65D 85/546 | 206/312 |
| 4,332,095 A * | 6/1982 | Tanney | A47G 1/141 | 40/771 |
| 4,450,638 A * | 5/1984 | Bader | A47G 1/141 | 40/754 |

(Continued)

*Primary Examiner* — J. Gregory Pickett
*Assistant Examiner* — Gideon Weinerth
(74) *Attorney, Agent, or Firm* — Kevin Keener; Keener & Associates P.C.

(57) ABSTRACT

The invention is directed toward a protective sleeve for a comic book comprising a substantially rectangular pocket comprising a front cover panel and a back cover panel, a substantially rectangular flap portion extending from the back cover panel comprising a first crease, an inner panel portion, a second crease, and an outer panel portion. The outer front panel portion has an adhesion area. The pocket has an adhesive strip disposed on the back cover panel. The front cover panel has an opening through which the cover of a comic book can be disposed. The front cover panel is folded over from the back cover panel. The flap portion may be wrapped around the pocket such that the inner front panel portion covers the front cover panel, the outer front panel portion covers the back cover panel, and the back cover panel is secured to the adhesive strip.

15 Claims, 12 Drawing Sheets

(56) References Cited

U.S. PATENT DOCUMENTS 4,648,860 A * 3/1987 Cassey ..... B65D 27/00 229/72
5,085,318 A * 2/1992 Leverick ..... G11B 33/0422 206/308.1
5,154,284 A * 10/1992 Starkey ..... G11B 33/0494 206/308.1
5,328,207 A * 7/1994 Hannah ..... B42D 15/00 283/70
5,377,733 A * 1/1995 Halley ..... A45C 11/18 150/147
5,380,047 A * 1/1995 Molee ..... G06K 19/16 283/74
5,460,265 A * 10/1995 Kiolbasa ..... B65D 85/546 206/308.1
D401,274 S * 11/1998 Sills ..... D19/26
6,578,757 B1 * 6/2003 Espenshied ..... B65D 27/00 229/92.8
7,127,844 B2 * 10/2006 Collins ..... G09F 1/00 206/45.24
2002/0117410 A1 * 8/2002 Butler ..... G11B 33/0422 206/312
2005/0072694 A1 * 4/2005 Hodess ..... B65D 85/548 206/312
2005/0247769 A1 * 11/2005 Potter ..... B65D 27/06 229/305
2014/0102929 A1 * 4/2014 Moellers ..... A45C 11/18 206/425
2014/0143033 A1 * 5/2014 Cecchi ..... B65D 75/36 705/14.4
2014/0231293 A1 * 8/2014 Nietvelt ..... B65D 75/14 206/449
2015/0102098 A1 * 4/2015 Adams ..... H04L 67/1097 235/375
2015/0368020 A1 * 12/2015 Kwan ..... B65D 33/04 206/459.5
2017/0096270 A1 * 4/2017 Jauregui ..... B65D 65/02

* cited by examiner

COMIC PROTECTOR

FIELD OF THE INVENTION

The invention pertains generally to comic protector sleeves and more specifically to a comic protector having a window opening permitting easy endorsing of a comic and wrap portion for quick protection of the comic after endorsement.

BACKGROUND OF INVENTION

Comic books can be very valuable. Some comic book series have an enhanced inherent value due to the artwork and story lines of the particular comic. Additionally, some comics are issued in limited runs or special issues. Because of the enhanced value of these comics, collectors desire to protect them by placing them in plastic protective sleeves as those comics in physically superior condition have a higher value.

Collectors desire to have comics endorsed by authors or artists to enhance the value of the comic. After having the comic endorsed the collector then places the comic in a protector sleeve to protect the value of the endorsed comic. There is a problem though with the current art of comic protectors. A user may wait until a comic is endorsed to place it in a protective sleeve but this places the comic at risk of being physically degraded while unprotected. A user may place a comic in a protector before having it endorsed but will have to remove it for endorsement. However, during the process of removing and replacing the comic from the protector, there is an increased risk of physically damaging the comic and thereby lowering its value. What is needed is a comic protector in which a comic may be placed and remain in the protector during the endorsement process.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a protective sleeve for a comic book comprising a substantially rectangular pocket comprising a front cover panel (20) and a back cover panel (40), a substantially rectangular flap portion extending from the back cover panel (40) comprising a first crease (30) disposed adjacent to the back cover panel (40), an inner panel portion disposed adjacent to the first crease (30) comprising an inner front panel portion (24) and an inner back panel portion (42), a second crease (32) disposed adjacent to the inner panel portion, and an outer panel portion disposed adjacent to the second crease (32) comprising an outer front panel portion (26) and an outer back panel portion (44), the outer front panel portion (26) having an adhesion area (34) disposed at an end of the flap portion, and an adhesive strip (38) disposed on the back cover panel (40) adjacent to the first crease (30). The front cover panel (20) has an opening (22). The front cover panel (20) is folded over from the back cover panel (40). Two outer edges of the front cover panel (20) are respectively heat sealed to two outer edges of the back cover panel (40). The flap portion may be wrapped around the pocket such that the inner front panel portion (24) substantially covers a surface of the front cover panel (20), the second crease (32) is disposed over an outer edge of the front cover panel (20) and the back cover panel (40), the outer front panel portion (26) substantially covers a surface of the back cover panel (40), and the adhesive strip (38) removably secures the back cover panel (40) at the adhesion area (34).

In another embodiment the protective sleeve is composed of a thermoplastic polymer. In another embodiment the thermoplastic polymer is polypropylene, polystyrene, or acid-free polypropylene. In another embodiment the back cover panel (40) substantially measures 7.06 inches wide by 10.88 inches long, the inner panel substantially measures 7.16 inches wide by 10.88 inches long, and the outer panel substantially measures 7.06 inches wide by 10.88 inches long. In another embodiment the opening (22) substantially measures 4.75 inches wide by 7.50 inches long. In another embodiment the thermoplastic is transparent. In another embodiment the protective sleeve further comprises a removable non-adhesive peel covering the adhesive strip (38).

The invention is also directed toward a method for protecting a comic comprising placing a comic in a protective sleeve for a comic book, ensuring a cover of the comic book is disposed in the opening (22), folding the flap portion such that the inner front panel portion (24) substantially covers a surface of the front cover panel (20), the second crease (32) is disposed over an outer edge of the front cover panel (20) and the back cover panel (40), and the outer front panel portion (26) substantially covers a surface of the back cover panel (40), and removably securing the adhesion area (34) to the adhesive strip (38).

The method may further comprise obtaining an endorsement on the cover of the comic book. The method may further comprise removing a removable non-adhesive peel covering the adhesive strip (38) from the adhesive strip (38) prior to removably securing the adhesion area (34) to the adhesive strip (38).

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Figure 1:
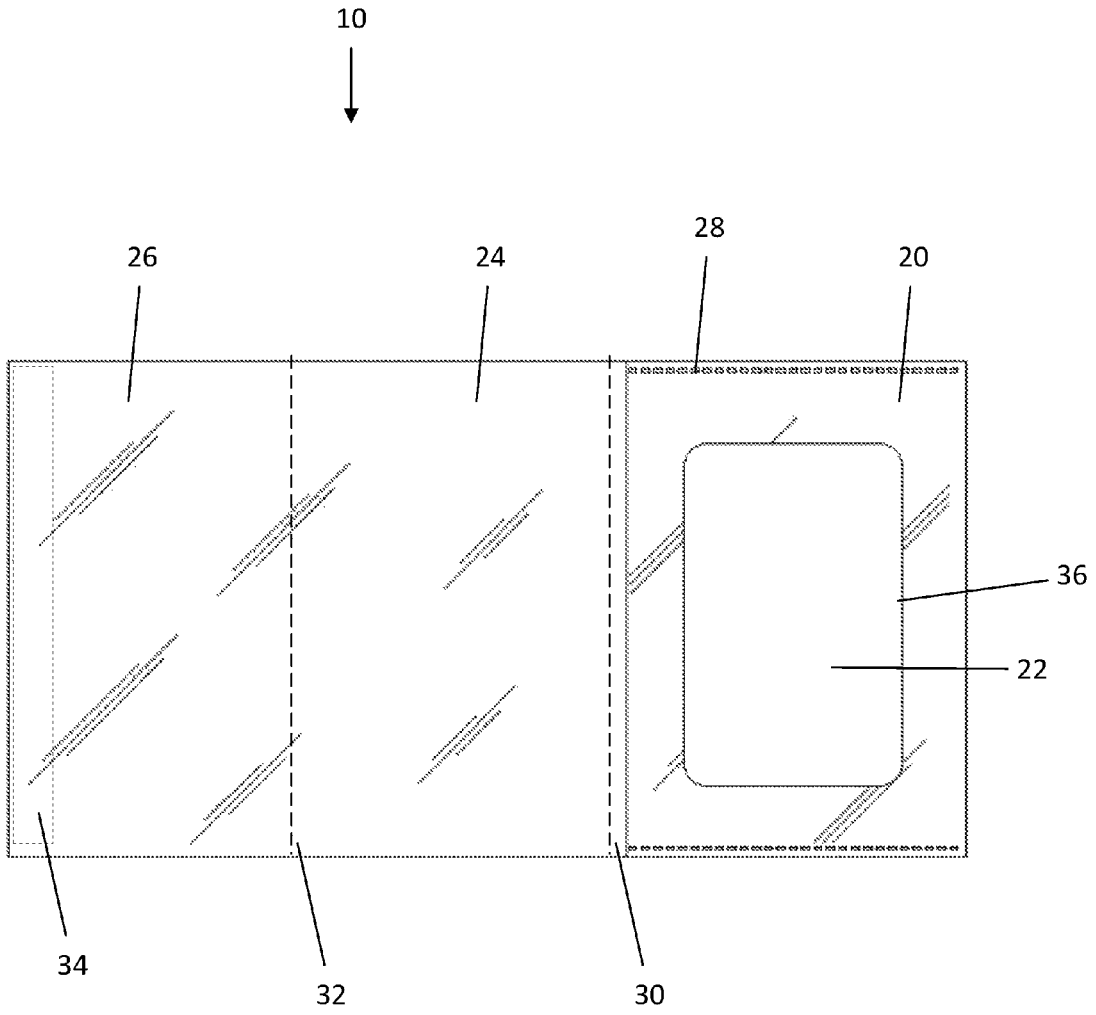
FIG. 1 is a top plan view of the comic protector.
Figure 2:
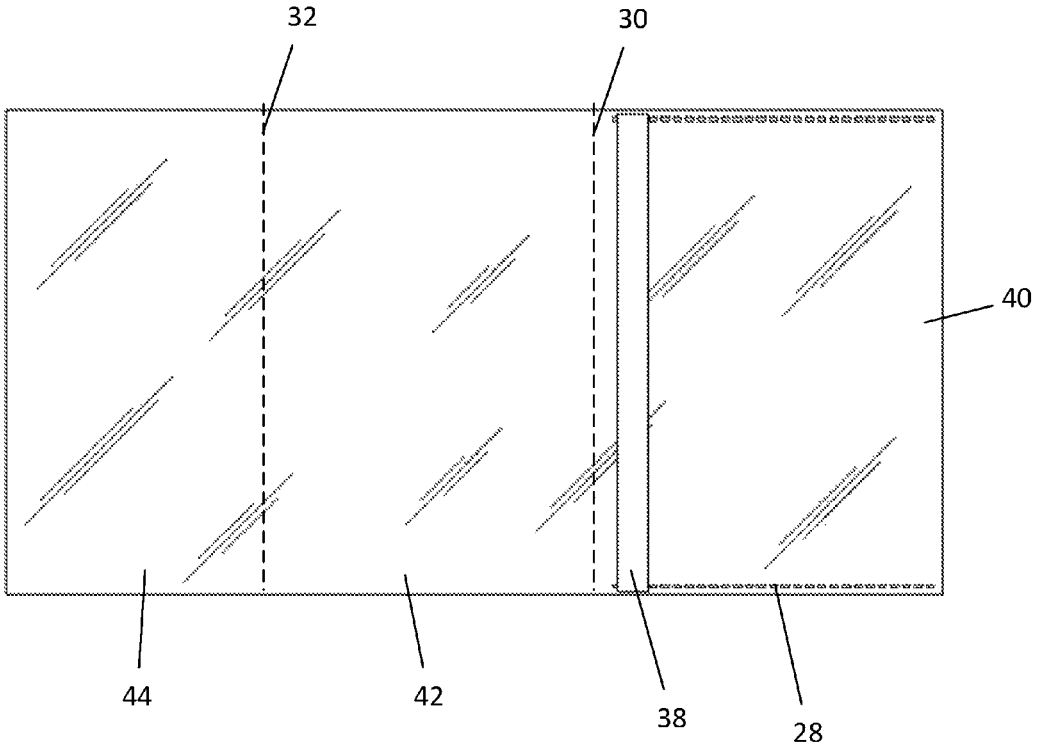
FIG. 2 is a bottom plan view of the comic protector.

Referring to FIG. 1 and FIG. 2, the preferred embodiment of the comic protector 10 is displayed. The comic protector 10 is a substantially rectangular body formed from a transparent or translucent thermoplastic. The comic protector 10 has a front side, which is illustrated in FIG. 1, and a back side disposed opposite of the front side, which is illustrated in FIG. 2. As shown in FIG. 1, the comic protector 10 has a front cover panel 20 containing an opening 22. The opening 22 is defined by a rim 36. The rim 36 is an edge of the front cover panel 20 forming a perimeter of the opening 22 which is accessible to the inner pocket of the comic protector 10. The opening 22 may be any size and shape in the front cover panel 20. The front cover panel 20 has a heat seal 28 disposed at the edges of the front cover panel 20. The heat seal 28 may be disposed on two or three edges of the front cover panel 20. The heat seal 28 connects the front cover panel 20 to the back cover panel 40 to create an inner pocket for holding a comic. As illustrated in FIG. 1 and FIG. 2, the comic protector 10 has two heat seals 28 disposed on opposite edges. The outer edge of the front cover panel 20 is connected to the outer edge of the back cover panel 40 so that the front cover panel 20 is folded over the back cover panel 40 at the outer edge. At the opposite side of the front cover panel 20 from outer edge is an opening through which a user may insert a comic into the inner pocket. In other embodiments there may be three edges heat sealed together. In other embodiments the opening to the pocket may be along a separate edge of the front cover panel 20.

As shown in FIG. 1, disposed adjacent to the front cover panel is a first crease 30. Disposed adjacent to the first crease 30 is an inner front panel portion 24. Disposed adjacent to the inner front panel portion 24 is a second crease 32. Disposed adjacent to the second crease 32 is an outer front panel portion 26. Disposed at the very outer edge of the outer front panel portion 26 is an adhesion area 34.

As shown in FIG. 2, the back side of the comic protector 10 is illustrated. The back cover panel 40 is disposed underneath the front cover panel 20. On the inner edge of the back cover panel 40 is an adhesive strip 38. The adhesive strip 38 may be any type of adhesive which is configured to permit the adhesion area 34 to be removably secured to the adhesive strip 38. In the preferred embodiment the adhesive strip 38 has a protective cover which the user removes to uncover the adhesive. Extending from the back cover panel 40 is the inner back panel portion 42. The first crease 30 is disposed between the back cover panel 40 and the inner back panel portion 42. Extending from the inner back panel portion 42 is the outer back panel portion 44. The second crease 32 is disposed between the inner back panel portion 42 and the outer back panel portion 44.

The first crease 30 and second crease 32 are folds in the thermoplastic permitting the folding of the comic protector 10 along the fold lines. The first crease 30 and second crease 32 run along the width of the comic protector 10. The panels on each side of the first crease 30 and second crease 32 fold toward the front side of the comic protector 10 so that the opening 22 is fully covered after being in a folded configuration.

Figure 3:
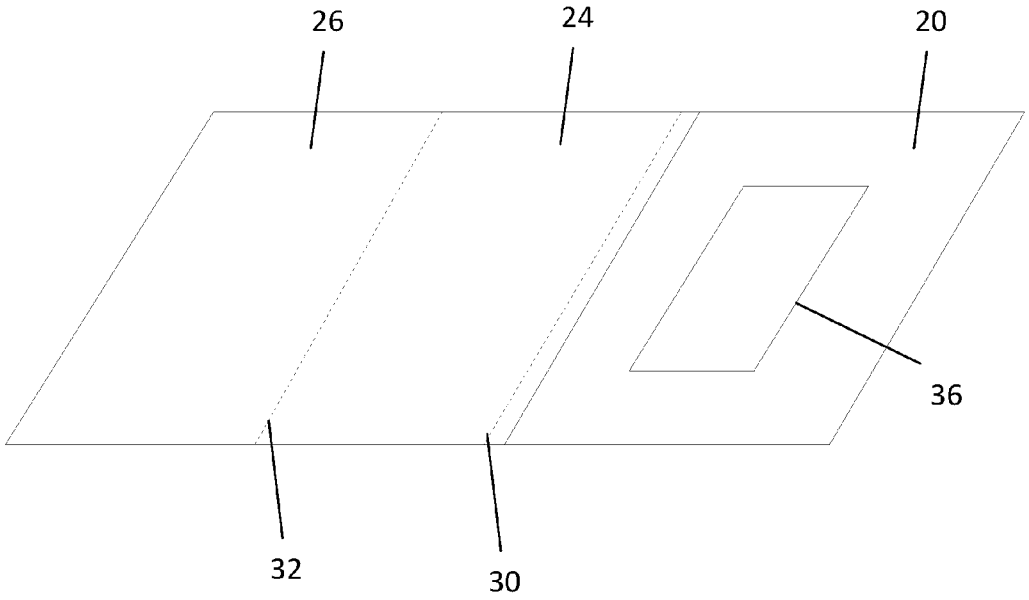
FIG. 3 is a top perspective view of the comic protector.
Figure 4:
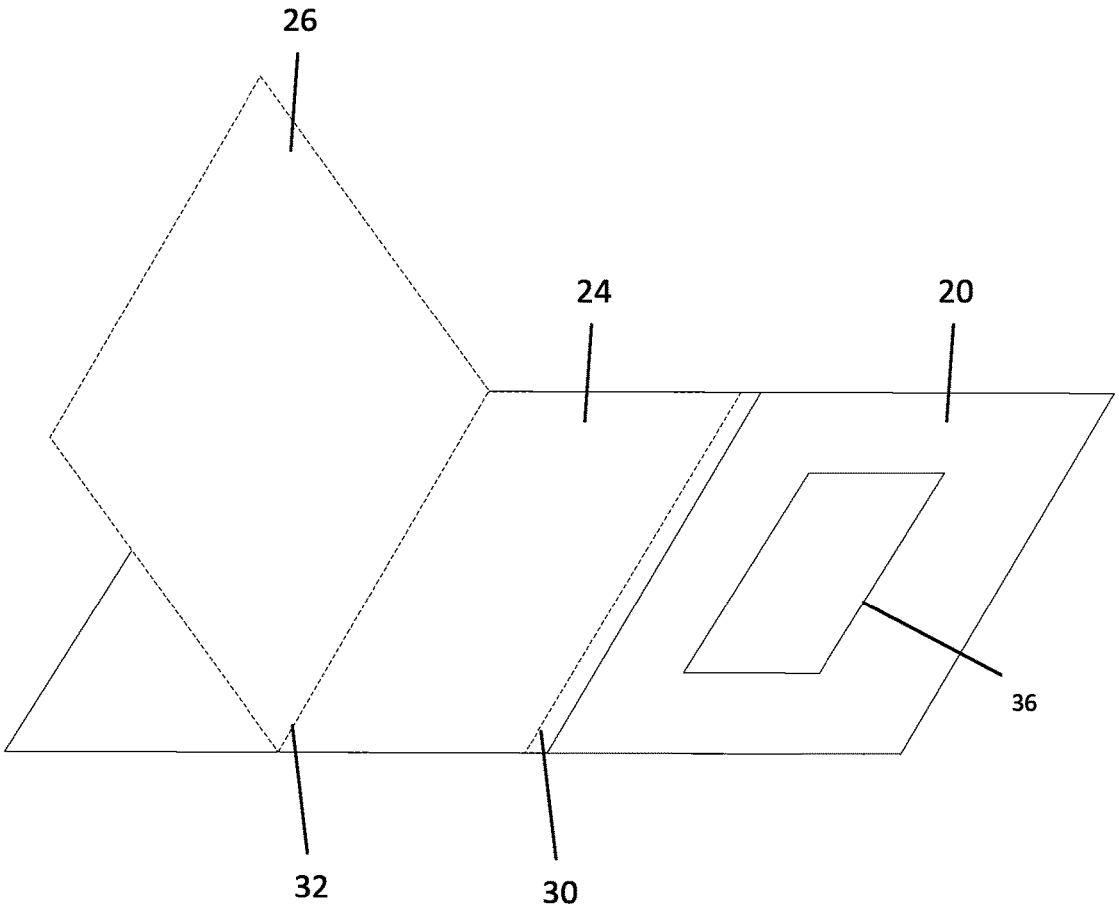
FIG. 4 is a top perspective view of the comic protector.

Referring to FIG. 3 through FIG. 9, the process of folding the comic protector 10 is illustrated. As shown in FIG. 3, the comic protector 10 is unfolded, front side up, with the outer back panel portion 44 front cover panel 20 on the right side, inner front panel portion 24 in the middle, and outer front panel portion 26 on the left. As shown in FIG. 4, the far outer portion of comic protector 10 is an outer panel disposed adjacent to the second crease 32 and comprises the outer front panel portion 26 and outer back panel portion 44. The outer panel rotates upward along the second crease 32.

Figure 5:
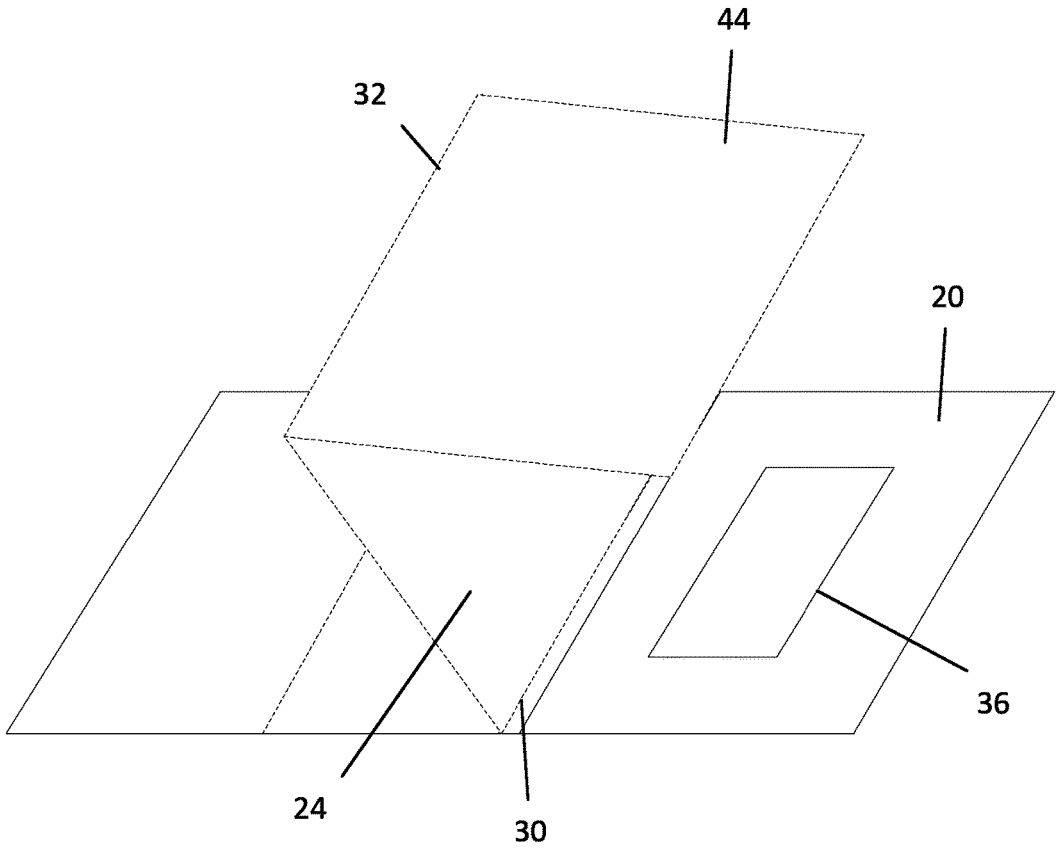
FIG. 5 is a top perspective view of the comic protector.
Figure 6:
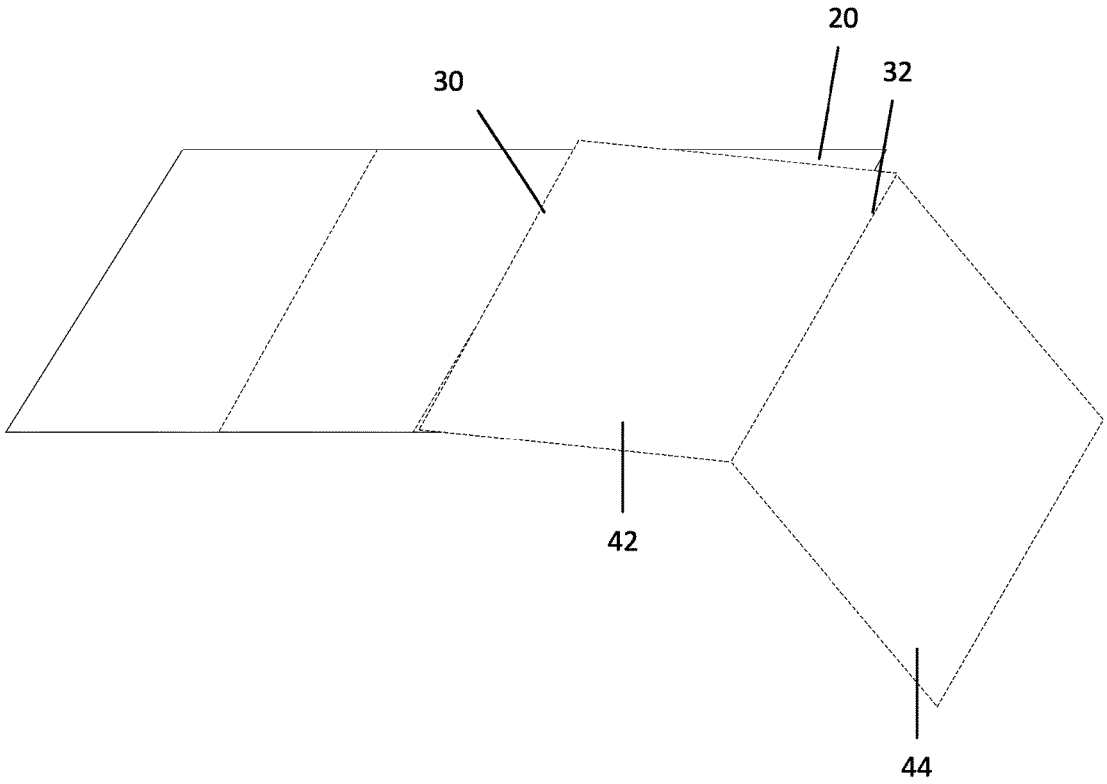
FIG. 6 is a top perspective view of the comic protector.
Figure 7:
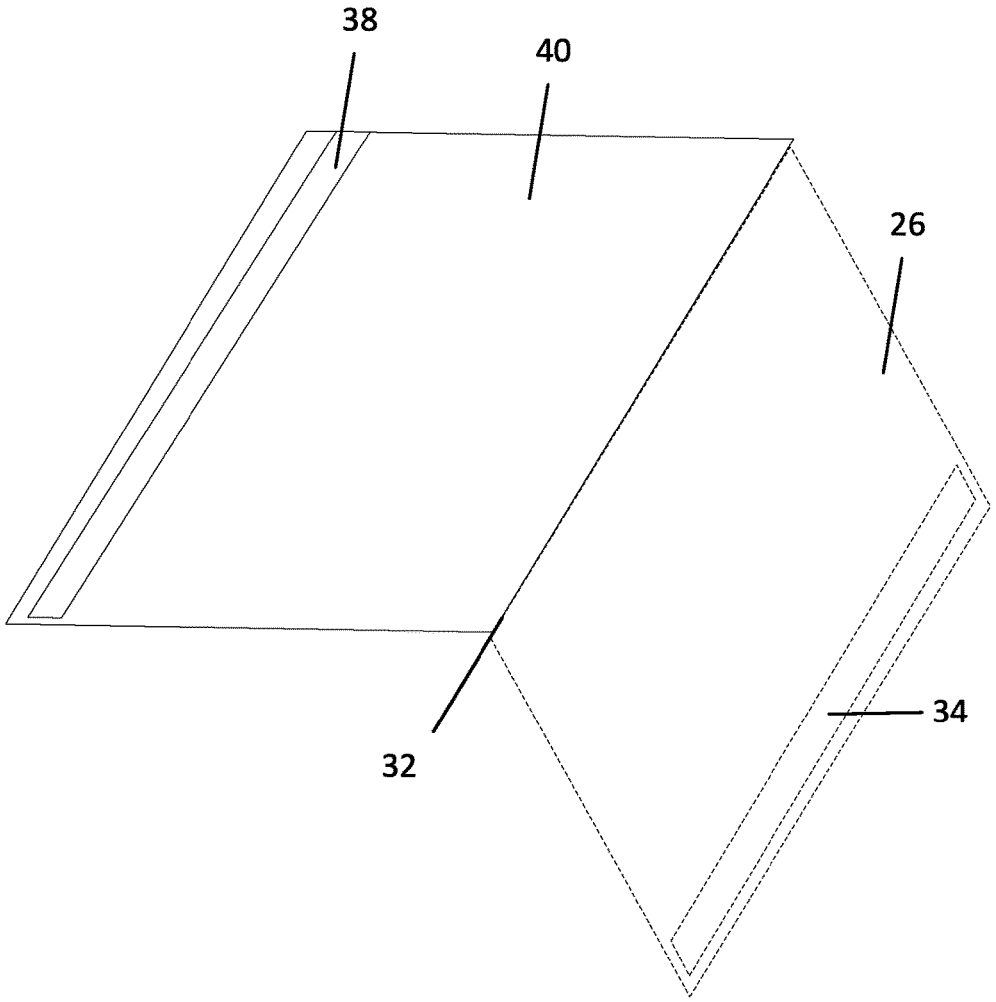
FIG. 7 is a is a bottom perspective view of the comic protector.
Figure 8:
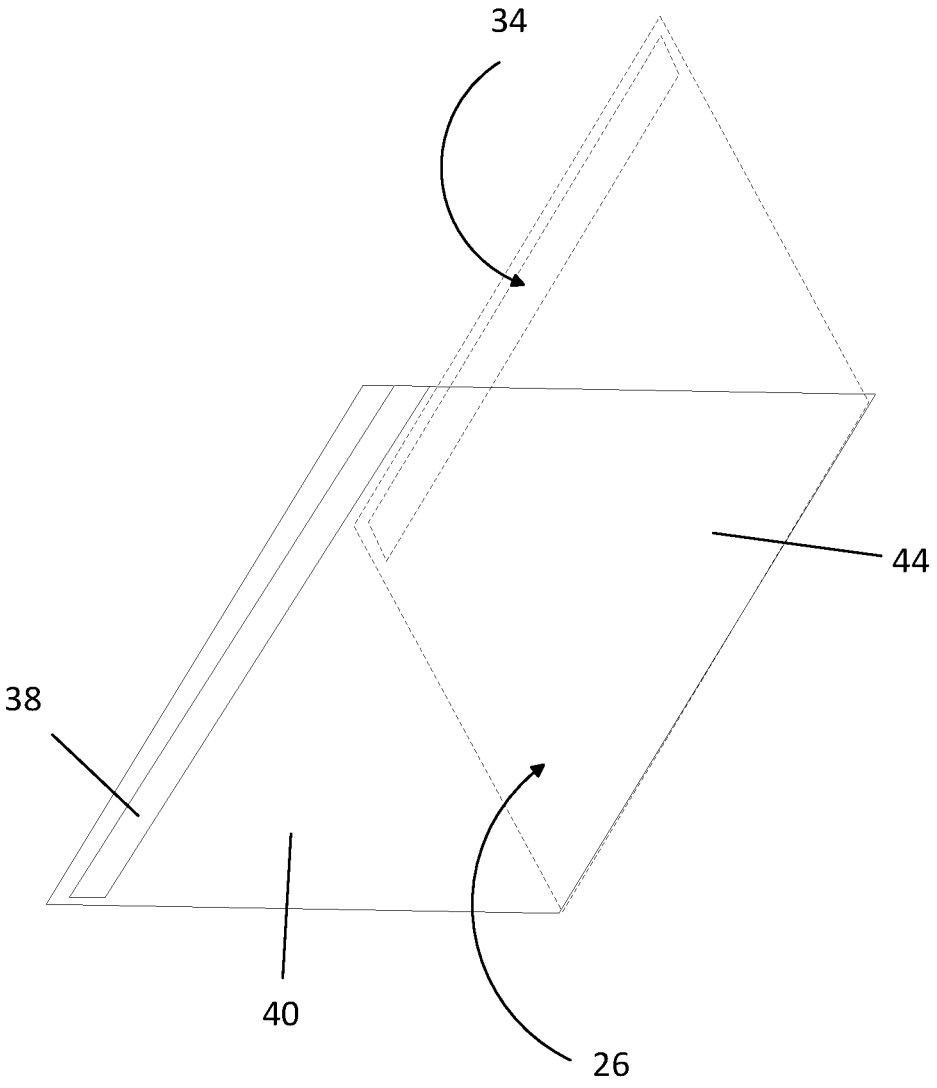
FIG. 8 is a bottom perspective view of the comic protector.
Figure 9:
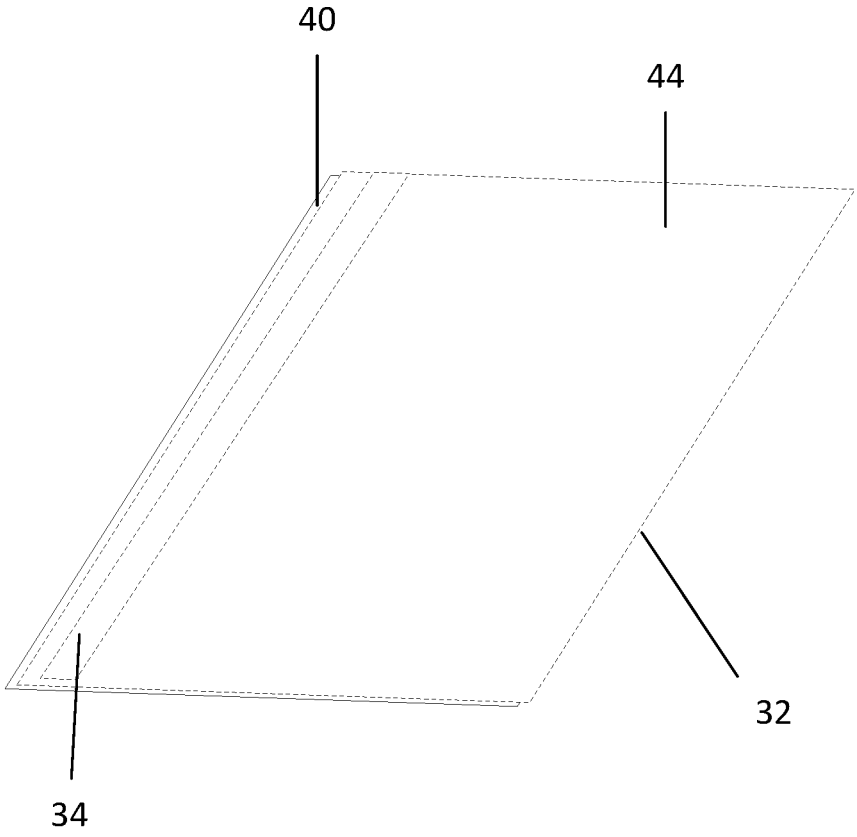
FIG. 9 is a bottom perspective view of the comic protector.

As shown in FIG. 5, the inner panel is disposed between the first crease 30 and the second crease 32 and comprises the inner front panel portion 24 and the inner back panel portion 42. The inner panel rotates upward along the first crease 30. As shown in FIG. 6, the inner panel rotates along the first crease 30 such that the inner front panel portion 24 abuts the front cover 20 and fully covers the opening 22. The outer panel folds along the second crease 32. As shown in FIG. 7 and FIG. 8, the second crease 32 is disposed at the outer edge of the front cover 20. The outer panel rotates along the second crease 32 so that the outer front panel portion 26 abuts the back cover 40. This leaves the outer back panel portion 44 disposed on the outside of the comic protector 10 as shown in FIG. 9. The adhesion area 34 overlays the adhesive strip 38 to removably secure the outer front panel portion 26 to the back cover 40.

Figure 10A:
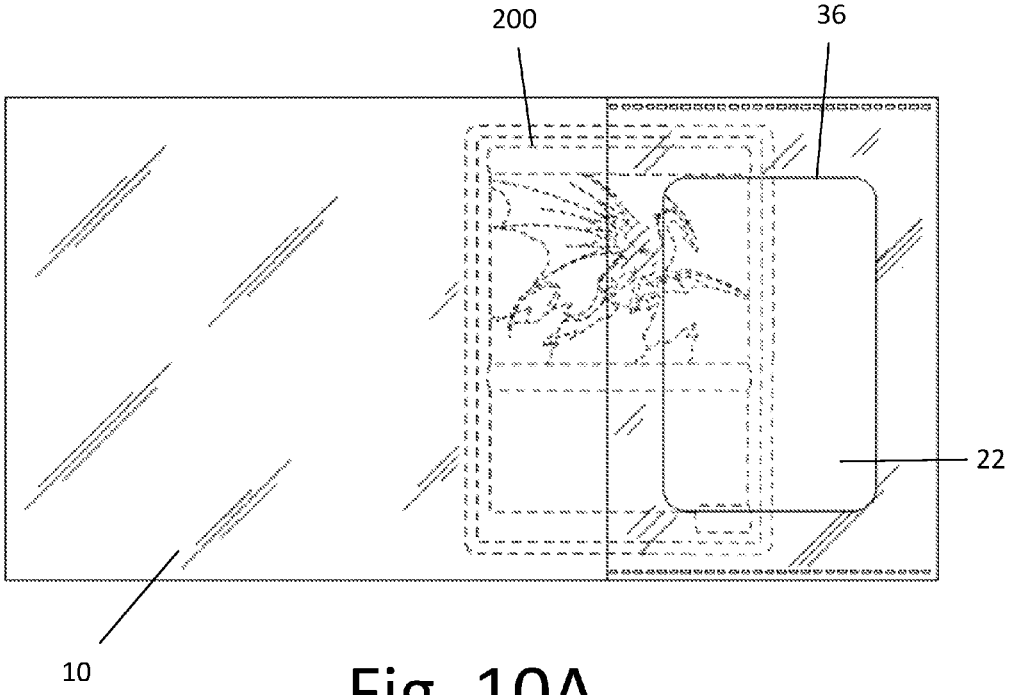
FIG. 10A is a top plan view of the comic protector with a comic.
Figure 10B:
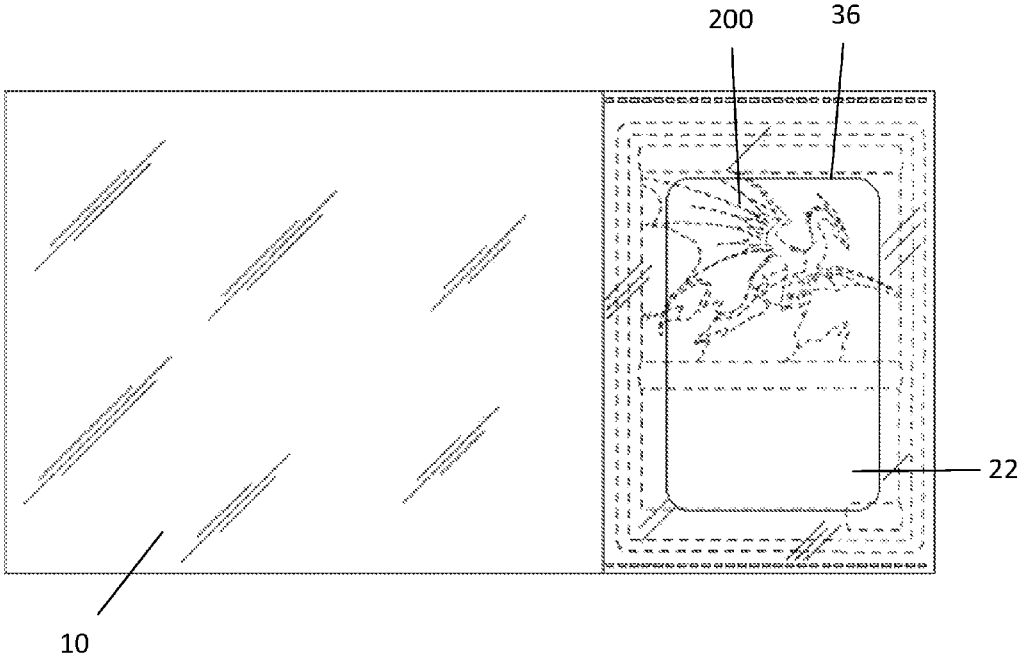
FIG. 10B is a top plan view of the comic protector with a comic.
Figure 10C:
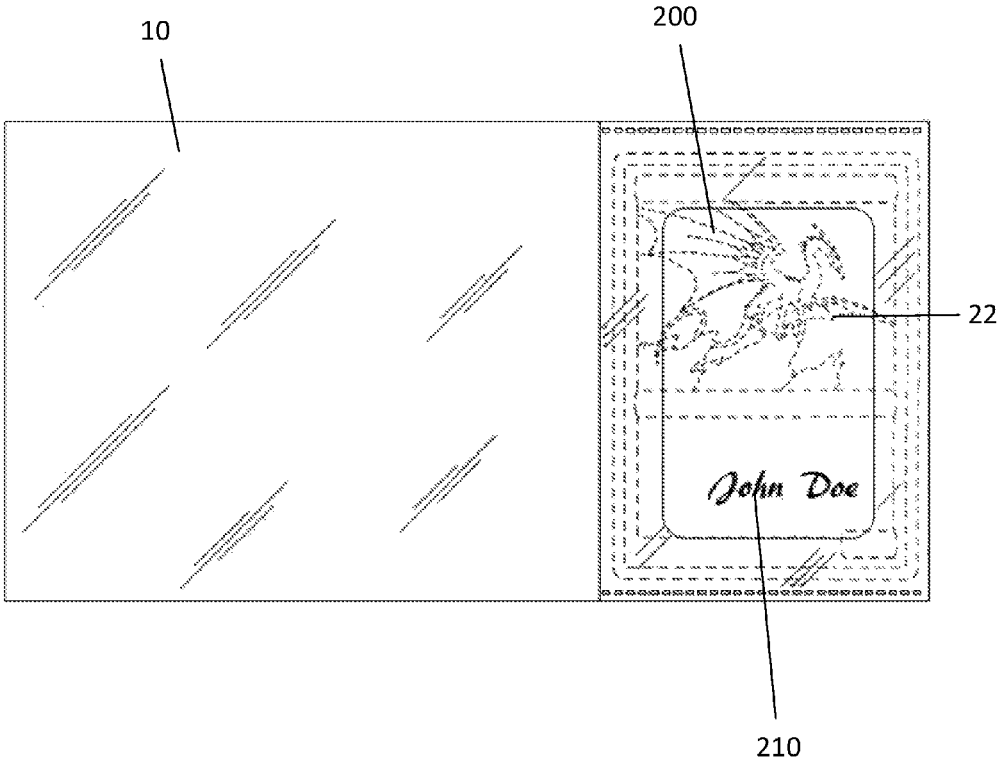
FIG. 10C is a top plan view of the comic protector with a comic.

Referring to FIG. 10A through FIG. 10C, the process of inserting a comic 200 in the comic protector 10 is illustrated. First, as shown in FIG. 10A, the user inserts the comic 200 into the inner pocket behind the front cover 20. The comic 200 may be inserted into the comic protector 10 in any manner. However, in the preferred embodiment, the user inserts the spine of the comic 200 into the comic protector 10 first in order to protect the physical integrity of the comic 200 and prevent the comic 200 from being damaged. Other comic protectors are often configured so that the comic is inserted at the edge of the paper, or bottom of the comic, which may cause damage to the pages. The present invention prevents this by being configured so that the spine is inserted first.

As shown in FIG. 10B, the comic 200 is uncovered and fully accessible through the opening 22. As shown in FIG. 10C, the collector may then have the comic 200 endorsed with an autograph 210. After obtaining the autograph 210 the collector then folds the comic protector 10 as illustrated in FIG. 3 through FIG. 9.

Figure 11:
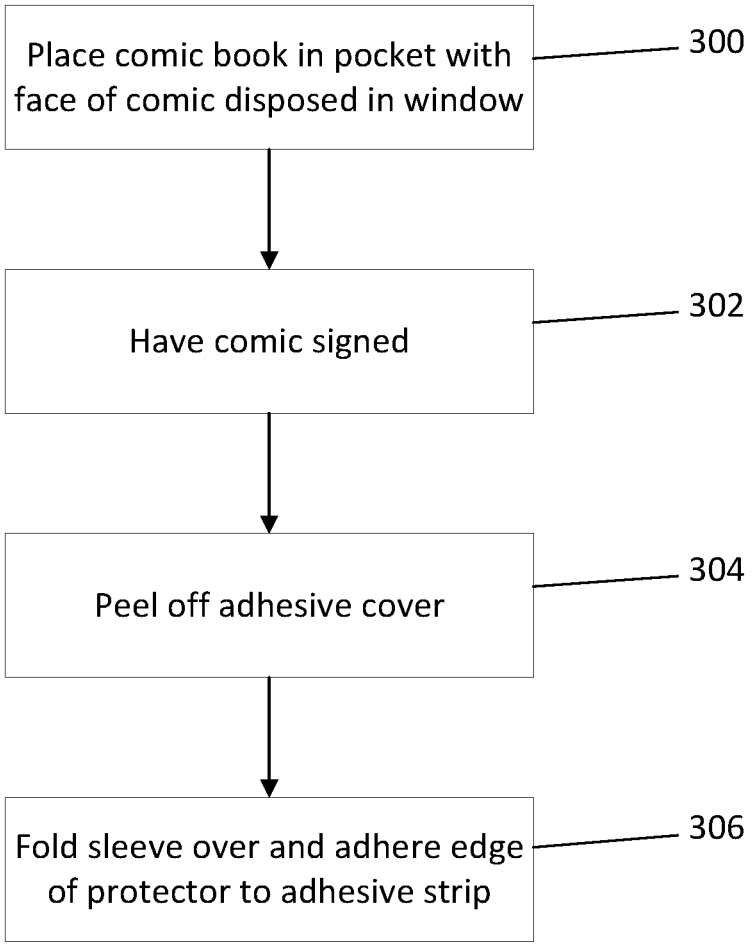
FIG. 11 is a schematic of the method of using the comic protector.

Referring to FIG. 11, the method of using the comic protector 10 is illustrated. First the user places the comic book in the pocket with the face of the comic disposed toward the opening 300. Then the user can have the comic endorsed by the author or artist 302. After the endorsement the user then removes the adhesive cover 304. The user then folds the comic protector and adheres the edge of the comic protector to the adhesive strip 306.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A protective sleeve for a comic book comprising a) a substantially rectangular pocket comprising a front cover panel (20) and a back cover panel (40), wherein said front cover panel (20) has an opening (22)
   i) wherein said front cover panel (20) is folded over from said back cover panel (40);
   ii) wherein two outer edges of said front cover panel (20) are respectively heat sealed to two outer edges of said back cover panel (40);

b) a substantially rectangular flap portion extending from said back cover panel (40) comprising
   i) a first crease (30) disposed adjacent to said back cover panel (40);
   ii) an inner panel portion disposed adjacent to said first crease (30) comprising an inner front panel portion (24) and an inner back panel portion (42);
   iii) a second crease (32) disposed adjacent to said inner panel portion;
   iv) an outer panel portion disposed adjacent to said second crease (32) comprising an outer front panel portion (26) and an outer back panel portion (44), said outer front panel portion (26) having an adhesion area (34) disposed at an end of said flap portion;

c) an adhesive strip (38) disposed on said back cover panel (40) adjacent to said first crease (30);

d) wherein said flap portion may be wrapped around said pocket such that said inner front panel portion (24) substantially covers a surface of said front cover panel (20), said second crease (32) is disposed over an outer edge of said front cover panel (20) and said back cover panel (40), said outer front panel portion (26) substantially covers a surface of said back cover panel (40), and said adhesive strip (38) removably secures said back cover panel (40) at said adhesion area (34).

2. The protective sleeve as in claim 1 wherein said protective sleeve is composed of a thermoplastic polymer.

3. The protective sleeve as in claim 2 wherein said thermoplastic polymer is polypropylene, polystyrene, or acid-free polypropylene.

4. The protective sleeve as in claim 1 a) wherein said back cover panel (40) substantially measures 7.06 inches wide by 10.88 inches long;
b) wherein said inner panel substantially measures 7.16 inches wide by 10.88 inches long;
c) wherein said outer panel substantially measures 7.06 inches wide by 10.88 inches long.

5. The protective sleeve as in claim 1 wherein said opening (22) substantially measures 4.75 inches wide by 7.50 inches long.

6. The protective sleeve as in claim 1 wherein said thermoplastic is transparent.

7. The protective sleeve as in claim 1 further comprising a removable non-adhesive peel covering said adhesive strip (38).

8. The protective sleeve as in claim 3 a) wherein said back cover panel (40) substantially measures 7.06 inches wide by 10.88 inches long;
b) wherein said inner panel substantially measures 7.16 inches wide by 10.88 inches long;
c) wherein said outer panel substantially measures 7.06 inches wide by 10.88 inches long.

9. The protective sleeve as in claim 8 wherein said opening (22) substantially measures 4.75 inches wide by 7.50 inches long.

10. The protective sleeve as in claim 9 wherein said thermoplastic is transparent.

11. The protective sleeve as in claim 10 further comprising a removable non-adhesive peel covering said adhesive strip (38).

12. A method for protecting a comic comprising a) placing a comic in a protective sleeve for a comic book
   i) said protective sleeve comprising
      (1) a substantially rectangular pocket comprising a front cover panel (20) and a back cover panel (40), wherein said front cover panel (20) has an opening (22)
         (a) wherein said front cover panel (20) is folded over from said back cover panel (40);
         (b) wherein two outer edges of said front cover panel (20) are respectively heat sealed to two outer edges of said back cover panel (40);
      (2) a substantially rectangular flap portion extending from said back cover panel (40) comprising
         (a) a first crease (30) disposed adjacent to said back cover panel (40);
         (b) an inner panel portion disposed adjacent to said first crease (30) comprising an inner front panel portion (24) and an inner back panel portion (42);
         (c) a second crease (32) disposed adjacent to said inner panel portion;
         (d) an outer panel portion disposed adjacent to said second crease (32) comprising an outer front panel portion (26) and an outer back panel portion (44), said outer front panel portion (26) having an adhesion area (34) disposed at an end of said flap portion;

(3) an adhesive strip (38) disposed on said back cover panel (40) adjacent to said first crease (30);

(4) wherein said flap portion may be wrapped around said pocket such that said inner front panel portion (24) substantially covers a surface of said front cover panel (20), said second crease (32) is disposed over an outer edge of said front cover panel (20) and said back cover panel (40), said outer front panel portion (26) substantially covers a surface of said back cover panel (40), and said adhesive strip (38) removably secures said back cover panel (40) at said adhesion area (34);

b) ensuring a cover of said comic book is disposed in said opening (22);

c) folding said flap portion such that said inner front panel portion (24) substantially covers a surface of said front cover panel (20), said second crease (32) is disposed over an outer edge of said front cover panel (20) and said back cover panel (40), and said outer front panel portion (26) substantially covers a surface of said back cover panel (40);

d) removably securing said adhesion area (34) to said adhesive strip (38).

13. The method as in claim 12 further comprising obtaining an endorsement on said cover of said comic book.

14. The method as in claim 13 further comprising removing a removable non-adhesive peel covering said adhesive strip (38) from said adhesive strip (38) prior to removably securing said adhesion area (34) to said adhesive strip (38).

15. The method as in claim 12 further comprising removing a removable non-adhesive peel covering said adhesive strip (38) from said adhesive strip (38) prior to removably securing said adhesion area (34) to said adhesive strip (38).

* * * * *